US005487231A

United States Patent [19]

Grate

[11] Patent Number: 5,487,231

[45] Date of Patent: Jan. 30, 1996

[54] ATTRACTION BOARD FOR RETAINING AN ENLARGED FIGURE PANEL THEREON

[76] Inventor: Anton Grate, 405 Westridge, Joliet, Ill. 60435

[21] Appl. No.: 169,100

[22] Filed: Dec. 20, 1993

[51] Int. Cl.[6] ..... G09F 7/02

[52] U.S. Cl. ..... 40/618; 40/620

[58] Field of Search ..... 248/298, 309.1; 40/618, 620, 657, 611; 211/94; 403/3, 331

[56] References Cited

U.S. PATENT DOCUMENTS

| | | | |
|---|---|---|---|
| 382,143 | 5/1888 | Curzon | 40/618 X |
| 1,203,712 | 11/1916 | Dietz | 40/618 |
| 1,779,190 | 10/1930 | Send | 40/620 X |
| 1,887,591 | 11/1932 | Fugita | 40/618 |
| 2,082,432 | 6/1937 | von der Linden | 40/620 X |
| 3,077,687 | 2/1963 | Hanson | 40/618 |
| 3,084,464 | 4/1963 | Ladbury | 40/620 |
| 5,078,530 | 1/1992 | Kim | 403/331 X |

*Primary Examiner*—Kenneth J. Dorner
*Assistant Examiner*—Joanne Silbermann
*Attorney, Agent, or Firm*—Patnaude, Videbeck & Marsh

[57] ABSTRACT

An attraction board has a substantially vertically oriented back with a plurality of horizontal tracks thereon, each track having a downwardly extending upper lip and a upwardly extending lower lip for retaining a figure panel therebetween. A downwardly extending upper lip of an upper track, or an upwardly extending lower lip of a lower track is forwardly offset a greater distance from the back of the attraction board than is the complementary upwardly extending lower lip of an upper track, or the complementary downwardly extending upper lip of an upper track. As a result, an enlarged figure panel can be fitted under the upper edge of the downwardly extending upper lip of the upper track, and the bottom edge thereof fitted under the upwardly extending lower lip of the lower track.

5 Claims, 3 Drawing Sheets

13a
13b
15
16
15
20f
10
12
16
14
76
78
30
20
22
18
24e
20
20e
58a
20d
28
24d
24
84
20c
58
20
24c
60
82
24
24b
18
20b
72
58b
20a
80
18
32a
21
13c
20a
38
38b

ATTRACTION BOARD FOR RETAINING AN ENLARGED FIGURE PANEL THEREON

The present invention relates to attraction boards and in particular to attraction boards having a plurality of horizontal parallel tracks, each of which has an upper and lower lip for retaining a figure panel therebetween.

BACKGROUND OF THE INVENTION

Various types of attraction boards are available and among the more common are those having a plurality of parallel tracks having rails between the tracks with the rails forming upwardly extending lower lips at the bottom of each track and a downwardly extending upper lip at the top of each track. Panels bearing numbers or letters thereon to be displayed can be arranged on the attraction board to spell out words or show numerals, such as prices or the like. In some cases, the attraction board and figure panels are partially transparent and are fitted with a back light such that the board and the text formed by the assembled figure panels is visible at night and present a brighter appearance during the daylight hours.

To change the figure panels on an attraction board having a plurality of tracks, it is customary to use a tool having a suction cup and an extended arm. The suction cup is attached to a figure panel and raised to the desired track with the upper edge of the figure panel fitted under the downwardly extending upper lip. Thereafter, the lower edge of the figure panel is moved across the upwardly extending lower edge of the track, and the suction cup released. The figure panel will then be retained between the upwardly extending lower lip and the downwardly extending upper lip of the track.

It is frequently desirable, however, to display enlarged figures on an attraction board. For example, it is desirable to display sales prices in enlarged numerals. Prior to the present invention, however, no adequate solution has been available for providing enlarged figures on an attraction board having a plurality of tracks. Enlarged figures have been attached to such attraction boards by printing the figures on panels which have lengths which would span two or more tracks. To install such figure panels on an attraction board, the upper end of a panel is fitted under the downwardly extending lip of an upper track and the lower end of the panel is fitted under the upwardly extending lip of a lower track, and the midsection of the panel is arched over the rails which are spanned by the enlarged panel.

Such prior art figure panels cannot be installed by an installer standing on the ground using an elongated tool with a suction cup at one end as previously described. To install such panels, an installer is required to climb a ladder and manually bend the enlarged panel to fit it under the upper and lower lips of the appropriate tracks.

It would therefore be desirable to provide an attraction board which can receive figure panels sized for a single track, or sized to span two or more tracks, and which can be installed by an installer standing on the ground using a tool having an extended arm and suction cup at the end thereof.

SUMMARY OF THE INVENTION

Briefly, the present invention is embodied in an attraction board having a substantially vertically oriented back with a plurality of horizontal tracks thereon, and specifically having a lower track and at least one upper track. Each track has a downwardly extending upper lip and an upwardly extending lower lip for retaining a figure panel therebetween.

In accordance with the present invention, the downwardly extending upper lip of one upper track is forwardly offset from the plane determined by the upper and lower lips of the lower track. As a result, an enlarged figure panel can be fitted with the upper edge thereof under the downwardly extending upper lip of the upper track and the bottom edge thereof fitted under the upwardly extending lower lip of the lower track.

Where it is desirable to provide a figure panel which extends over a plurality of tracks, the figure panel may be provided with one or more offset flanges extending from the rear side of the figure panel, and the offset flanges have ends which extend parallel to the upper and lower edges of the panel and are aligned to fit under a lip of an intermediate rail.

Enlarged figure panels as described above having one or more flanges adapted to fit under intermediate upwardly extending lower lips can be fitted onto an attraction board in accordance with the present invention by fitting the upper edge of the panel under the downwardly extending upper lip of an upper track and moving the lower edge of the panel and the lower edge of the intermediate flanges extending from the rear side of the figures panel across the associated upwardly extending lower lips and allowing the figure panel to drop into position. The upper edge of the panel will be retained under the downwardly extending upper lip of an upper track, the lower edge will be retained under the upwardly extending lower lip of a lower track, and the offset flanges will be retained under the upwardly extending lips of intermediate rails.

GENERAL DESCRIPTION OF THE DRAWINGS

Further objects and advantages and a better understanding of the present invention will be had by a reference to the following detailed description taken in conjunction with the accompanying drawings wherein.

DETAILED DESCRIPTION OF PREFERRED EMBODIMENTS OF THE INVENTION

Figure 1:
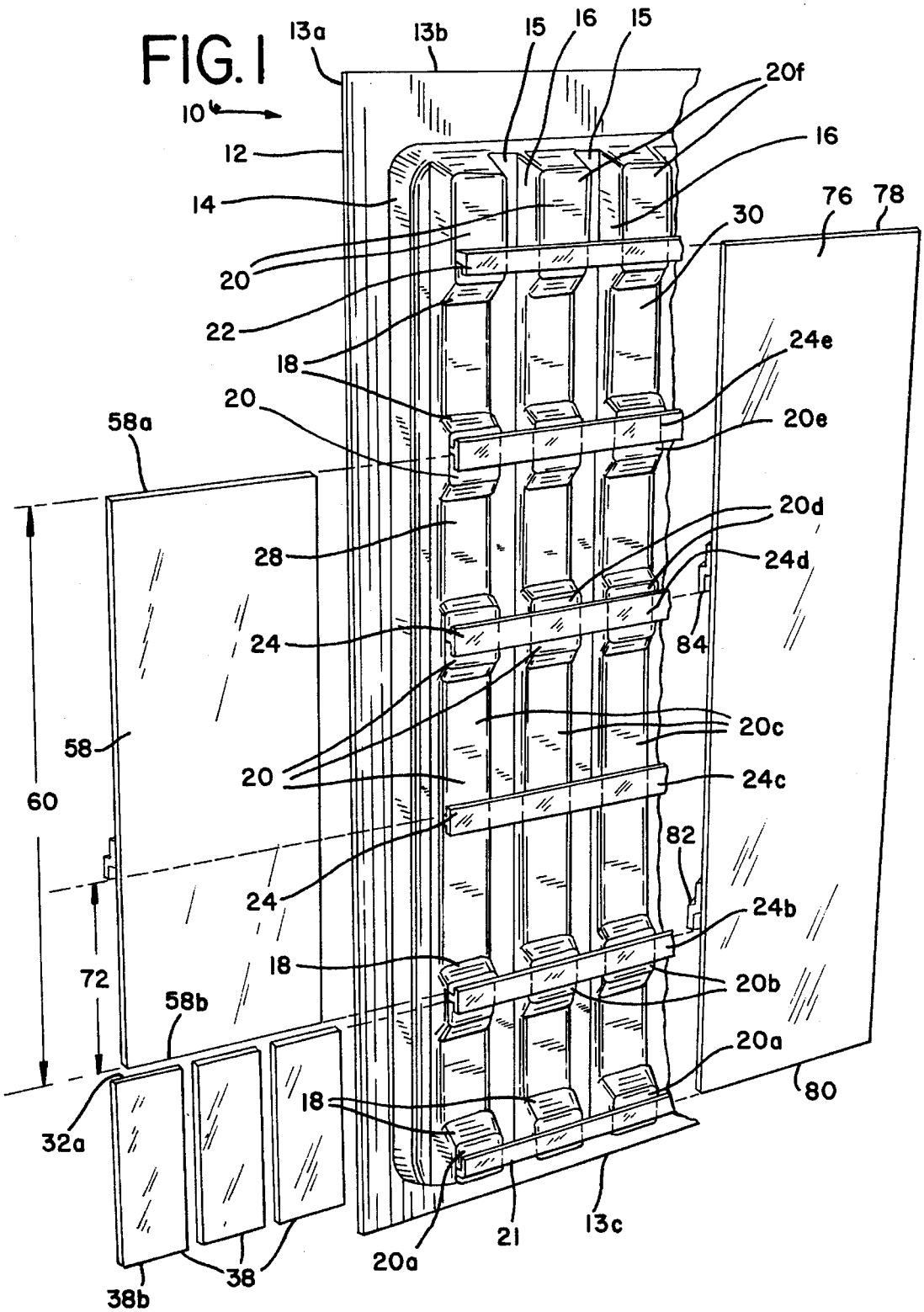
FIG. 1 is a fragmentary isometric view of an attraction board and a plurality of figure panels which embody the present invention.
Figure 2:
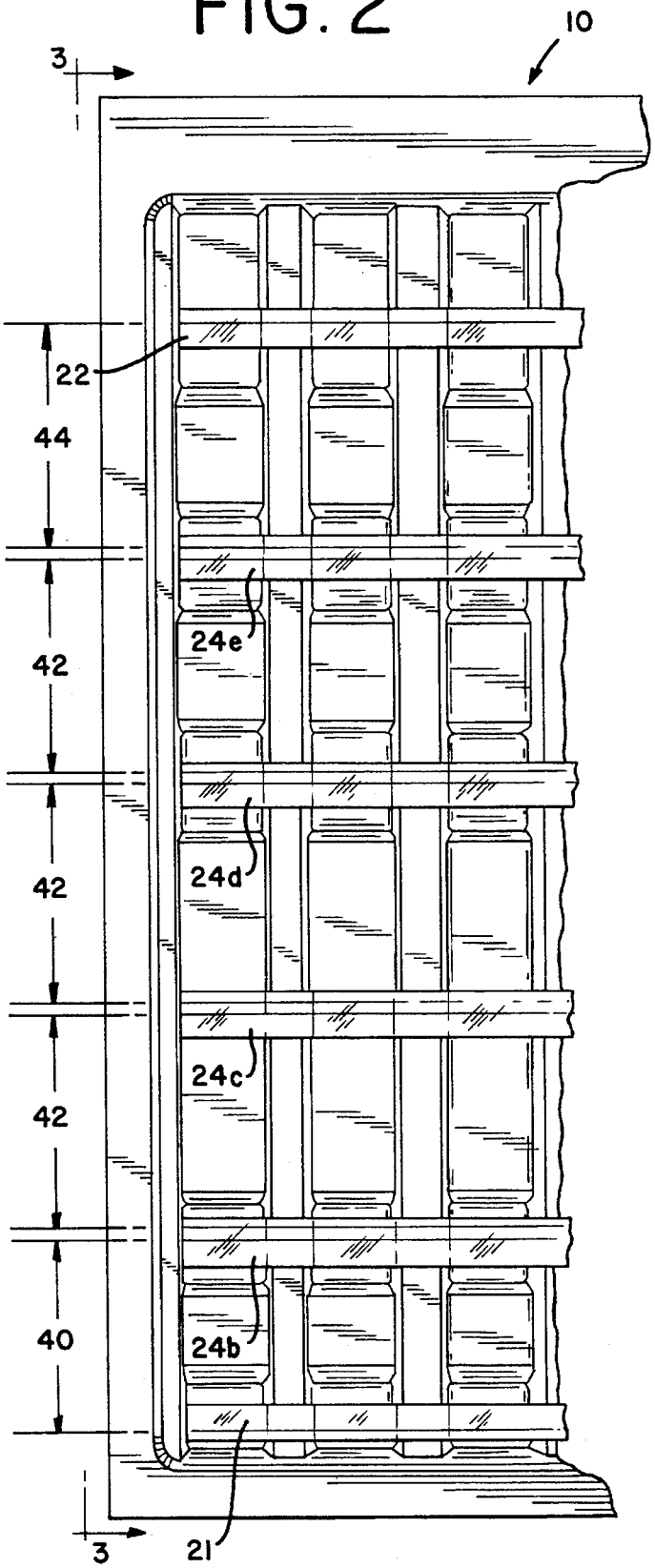
FIG. 2 is a fragmentary front elevational view of the figure panel shown in FIG. 1.
Figure 3:
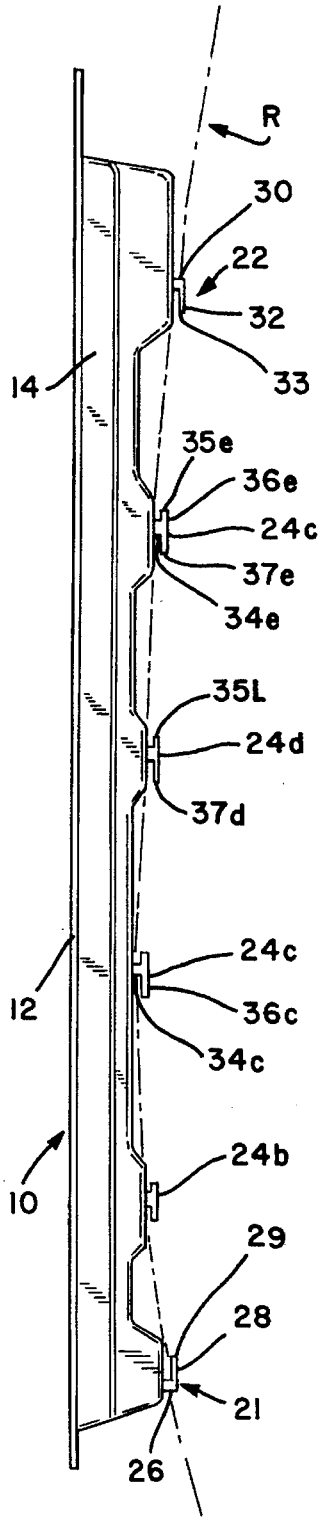
FIG. 3 is a side elevational view of the figure panel shown in FIG. 1.

Referring to FIGS. 1, 2 and 3, an attraction board 10 has a generally rigid vertically oriented back 12 and is made of a durable plastic or other suitable material. The back 12 has four outer edges identified generally as 13—13, of which side edge 13*a* is shown in full and the upper edge 13*b* and the lower edge 13*c* have only fragments thereof depicted. The edges 13*a*, 13*b*, 13*c* define the plane of the back 12. To provide rigidity to the back 12, the attraction board 10 has a plurality of horizontally and vertically oriented ridges and surfaces which are extruded into the attraction board 10 which are substantially perpendicular to the plane of the base 12. For the purpose of description, the portions of the attraction board 10 which are positioned a greater perpendicular distance from the plane of the back 12 than are other portions thereof will be described as being "forward" or "forwardly" of the other portions.

Positioned near the edges 13 of the back 12 is a border shoulder 14. Also, a plurality of substantially equally spaced apart vertically oriented grooves 15 are extruded into the surface of the attraction board 10 to form a plurality of spaced vertical surfaces 16—16. Substantially perpendicular to the plane of the vertical surfaces 16—16 are a plurality of smaller surfaces 18—18 the planes of which have a generally horizontal orientation. In addition to providing rigidity to the attraction board, the various surfaces 16—16, 18—18 which are extruded into the attraction board 10 define a plurality of elevated plateaus identified generally as 20—20. A first row or series of plateaus **20*a*—20*a* extend along the bottom of the figure panel 10 and the second series of plateaus 20*b*—20*b* are spaced above the lower plateaus 20*a*. Similarly, several more series of plateaus which bear indicia numbers 20*c*, 20*d*, 20*e*, and 20*f* are spaced and aligned in ascending positions above the corresponding plateaus 20*b* and 20*a*. It should be noted that the plane of the surface of each plateau 20—20 is forwardly offset from the plane of the back 12. All the plateaus 20—20 of each series, as for example the plateaus of series 20*b*—20*b*, are forwardly offset the same distance from the plane of the back 12. As can be seen in FIG. 1, however, the plateaus of series 20*c*—20*c* are forwardly offset the least distance from the plane of the back 12, and the plateaus of series 20*f*—20*f* have the greatest forward offset relative to the plane of the back 12**.

Extending horizontally across the bottom series of plateaus **20*a*—20*a* is a bottom rail 21, extending horizontally across the plateaus 20*f*—20*f* is an upper rail 22, and extending across the intermediate plateaus 20*b*–20*e* are a plurality of intermediate rails 24*b*–24*e***.

Referring to FIG. 3, it can be seen that the bottom rail 21 consists of a forwardly projecting support 26 and at the forward end thereof is attached a transverse plate 28 which is generally parallel to the plane of the back 12. The plate 28 forms an upwardly extending lower lip 29 which is forwardly offset a small distance from the surface of the plateau **20*a*—20*a* equal to the height of the support 26. The upper rail 22 also has a longitudinal forwardly projecting support 30 attached to which is a transverse planar plate 32. The plate 32 is forwardly offset from the surface of the plateau 20*f* to which it is attached and forms a downwardly extending upper lip 33. Similarly, each of the intermediate rails 24*b*–24*e* has a horizontally oriented forwardly projecting support member 34*b*–34*e* upon which is positioned a corresponding transverse plate 36*b*–36*e* which is generally parallel to the plane of the back 12 and forms an upwardly extending lower lip 35*b*–35*e* and a downwardly extending upper lip 37*b*–37*e***.

The attraction board 10, therefore, has a plurality of tracks, each track being defined by adjacent pairs of rails 21, 22, **24*b*–24*e* for retaining therebetween a figure panel 38, of the type known in the art and which has a generally rectangularly shaped body with upper and lower parallel edges 38*a* and 38*b*, respectively. Each figure panel 38 typically has a symbol 39 thereon such as a number or letter such that the panels 38 can be organized to spell out words and numbers when viewed from the front thereof. As can be seen in FIG. 1, the figure panels 38 can be fitted into a lowest track which has an upwardly extending lower lip 29 from the lower rail 21 and a downwardly extending upper lip 37*b* formed by the neighboring intermediate rail 24*b*. Where the support members 26, 30, 34*b*–34*e* of the various rails 21, 22, 24*b*–24*e* are equally spaced, figure panel 38 can be positioned between any of the tracks 40, 42, 44 of the attraction board 10**.

Referring to FIGS. 2 and 3, it can be seen that the downwardly extending upper lips 33, **37*b*–37*e* of the upper rail 22 and of the intermediate rails 24*b*–24*e* all extend an equal distance downwardly from the lower surface of the corresponding support member 30, 34*b*–34*e* . Similarly, the upwardly extending lower lips 29, 35*b*–35*e* of the lower rail 21 and the intermediate rails 24*b*–24*e* all extend an equal distance upwardly from the associated support member 26, 34*b*–34*e* . The rails thereby form the plurality of tracks described above, including lower track 40, a plurality of intermediate tracks 42 and an upper track 44**. The downwardly extending upper lips of each track extends downwardly a distance which is greater than the distance of the corresponding upwardly extending lower lip of the track to retain a figure panel having a height which allows for insertion and retention thereof between the lips as described below.

Figure 4:
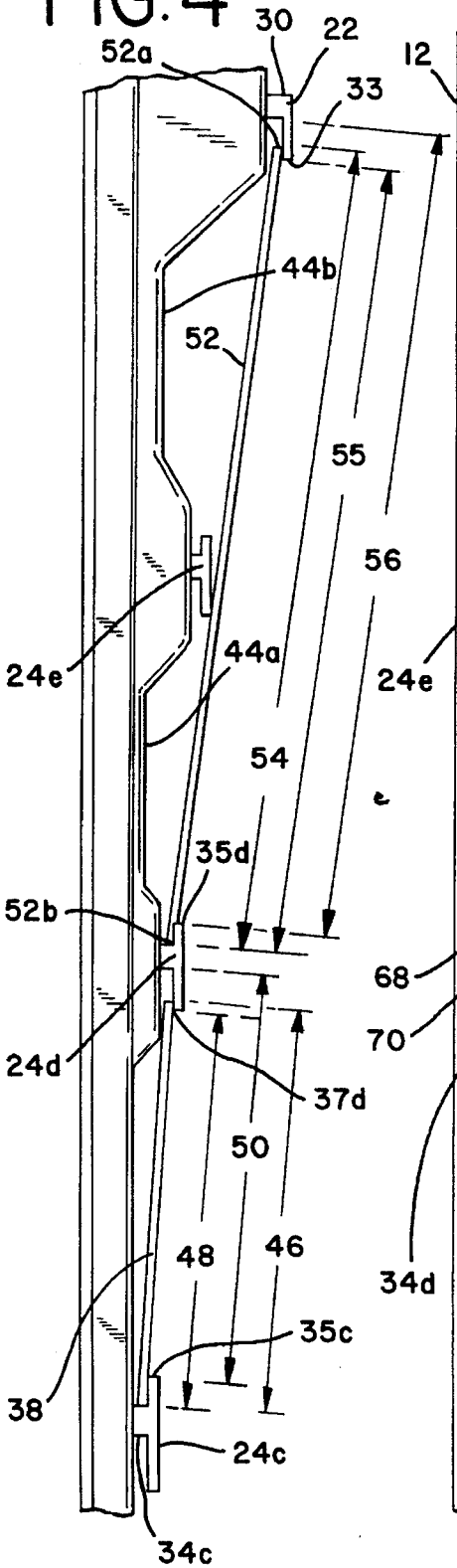
FIG. 4 is an enlarged fragmentary side view of an attraction board with the forward offset of the plateaus exaggerated and having a figure panel fitted in the lower track, and an enlarged figure panel extending across two upper tracks.

Referring to FIG. 4, a typical figure panel 38 has a height 46 which is greater than the distance 48 between the upper surface of the support member **34*c* of the rail depicted as 24*c*, and the lower edge of the downwardly extending upper lip 34*d* of the rail depicted as 24*d* and less than the distance 50 between the lower surface of the upper support member 34 and the upper edge of the upwardly extending lower lip 35*c* of rail 24*c*. The figure panel 38 can, therefore, be fitted into the track 44 by positioning its upper edge 38*a* under the downwardly extending upper lip 35*d* and moving the lower edge 38*b* of the figure panel 38 across the upwardly extending lower lip 37*c* of rail 24*c*, and then allowing the figure panel 38 to rest on the upper surface of the support member 34*c***.

Referring further to FIG. 4, an enlarged figure panel 52 having upper and lower edges **52*a*, 52*b*, respectively, is depicted which is suitable for extending across two tracks 44*a*, 44*b*. In this embodiment, the height 54 of the figure panel 52 is greater than the distance 55 between the upper surface of support member 34*d* of rail 24*d* and the lower edge of the downwardly extending upper lip 33 of rail 22, and shorter than the distance 56 between the bottom surface of support member 30 of rail 22 and the upper edge of the upwardly extending lower lip 35*d* of rail 24*d*. As can be seen, the figure panel 52 can be fitted between upper and lower lips 33, 35*d*, respectively, and will span across an intermediate rail 24*e* . It should be appreciated that the plastic of which such figure panels 38 are typically made will have some flex and the panel 38 may be installed as described above using an elongated tool with a suction cup and have some arching of the panel across the intermediate rail 24*e***.

As can be seen in FIG. 3, the lips 29, 33, **35*b*–35*e*, 37*b*–37*e* define an arc which is the surface of a cylinder. The ideal radius R of the arc on which the rails 21, 22, 24*b*–24*e* generally fall is the maximum radius for which figure panel 52 can be fitted across any two adjacent tracks and span the intermediate rail as depicted in FIG. 4. It should be appreciated that when the rails 21, 22, 24*b*–24*e* are all equally spaced, figure panel 52** can be fitted across any two adjacent tracks.

Figure 5:
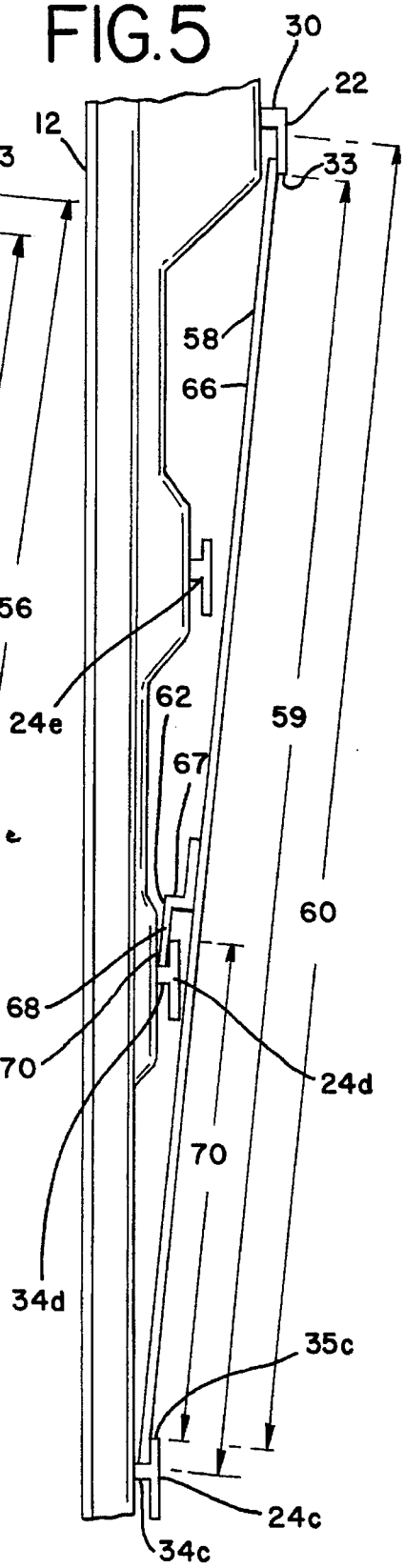
FIG. 5 is a fragmentary enlarged side view of the attraction board shown in FIG. 1 with the forward offset of the plateaus exaggerated and with another embodiment of an enlarged figure panel attached thereto.

Referring to FIGS. 1 and 5, another figure panel 58 is depicted embodying the present invention and is adapted to extend across three tracks. In this embodiment, the height of the figure panel 58, which is the distance between the upper and lower edges 58*a*, 58*b*, respectively, is greater than the distance 59 between the upper surface of the lower support member 34*c* of rail 24*c*, and the lower edge of the downwardly extending upper lip 33 of rail 22 and less than the distance 60 between the bottom surface of the support member 30 of rail 22 and the upwardly extending lower lip 35*c* of rail 24*c*. Also, positioned parallel to the upper and lower edges 58*a*, 58*b* of the panel 58 is an offset longitudinal flange 62 which is attached to the rear surface 66 thereof. The flange 62 consists of a support 67 at the end of which is a transverse planar plate 68 which is parallel to the plane of the panel 58. The plate 68 and the support 67 extend across the width of the panel 58 parallel to the upper and lower edges 58*a*, 58*b* thereof.

The flange 62 is offset a distance from the rear surface 66 a distance sufficient to enable the flange 62 to fit within the upwardly extending lower lip 35*d* of rail 24*d* and the lower edge 70 of the flange 62 is spaced a distance 72 from the lower edge 58*b* of the panel 58 which is equal to the distance 74 between the upper edge of upwardly extending lower lip 35*d* and the upper edge of the upwardly extending lower lip 35*c*. Figure panel 58 is attached to the attraction board 10 by fitting the upper edge 58*a* thereof under downwardly extending upper lip 33 and moving the lower edge 58*b* across the upper edge of the upwardly extending lower lip 37*a*. At the same time, the downwardly extending lower edge 70 of the flange 62 will pass over the edge of the upwardly extending lower lip 35*c*. As previously stated, the flexibility of the plastic of which the figure panel is constructed will accommodate imperfections in the various parts when the flange 62 is fitted over the upwardly extending lower lip 35*d*. It should also be noted that in this embodiment, the figure panel 58 will not be attached to intermediate rail 24*e* , but in fact will extend across the most forward surface thereof.

Figure 6:
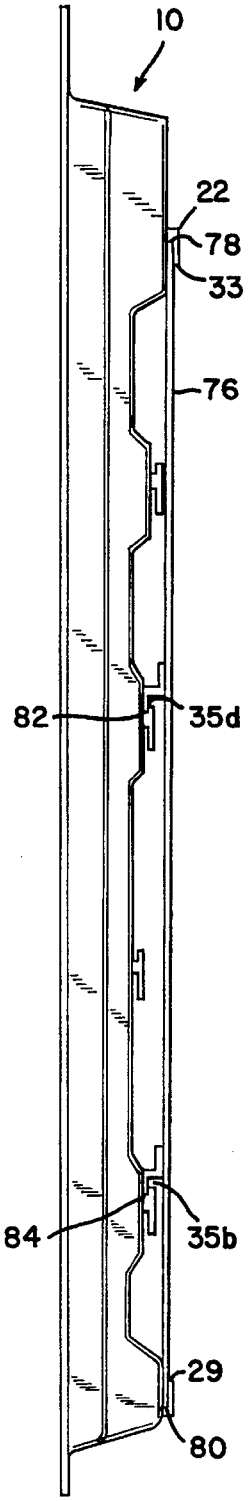
FIG. 6 is a side elevational view of the attraction board shown in FIG. 1 with another embodiment of an enlarged figure panel attached thereto.

Referring to FIGS. 1 and 6, in which another enlarged figure panel 76 is depicted, figure panel 76 is adapted to span five tracks and has an upper edge 78 and a parallel lower edge 80. In this embodiment, two offset longitudinal flanges 82, 84 positioned parallel to the upper and lower edges 78, 80 will attach over the upwardly extending lower lips 35*b*, 35*d* of rails 24*b* and 24*d*. The length of figure panel 76 is such that it can be attached to the attraction board 10 by fitting the upper edge 78 under the downwardly extending upper lip 33 of the upper rail 22 and the lower edge 80 and the lower edges of the flanges 82, 84 moved across the upwardly extending lower lips 29, 35*b*, 35*d* of the corresponding rails 21, 34*b*, 34*d*, and hooking the flanges 82, 84 behind the intermediate rails 24*b*, 24*d*, respectively. As described with regard to prior embodiments, the panel 76 will have some flexibility which will overcome imperfections of construction when the panel 76 is attached to the board 10.

While the present invention has been described in various specific embodiments, it will be appreciated by those skilled in the art that many changes may be made without departing from the true spirit and scope of the present invention. Therefore, it is intended by the appended claims to cover all such changes and modifications which come within the true spirit and scope of the invention.

What is claimed:

1. The combination comprising;

a back, a plurality of parallel tracks on said back, each of said tracks having an upwardly extending lower lip immovably fixed said back and an opposing downwardly extending upper lip immovably fixed to said back, said tracks including an upper track with an upper lip and a lower track with a lower lip, and an intermediate lip, one of said upper lip of said upper track and said lower lip of said lower track being forwardly offset relative to said intermediate lip, and a figure panel extending under said upper lip of said upper track and under said lower lip of said lower track, and across said intermediate lip.

2. A figure panel for attachment to an attraction board of the type having a plurality of parallel tracks, each track having a downwardly extending upper lip and an upwardly extending lower lip for retaining a figure panel there between, and one of said downwardly extending upper lip and said upwardly extending lower lip of one of said tracks forwardly offset relative to the other of said downwardly extending upper lip and said upwardly extending lower lip thereof, said figure panel comprising in combination:

a body having an upper edge, a lower edge, a rear surface, and a front, a downwardly extending flange offset from said rear surface and parallel to said upper edge and said lower edge, said downwardly extending flange positioned for fitting over an intermediate upwardly extending lip when said upper edge is fitted under a downwardly extending upper lip, and said lower edge is fitted under an upwardly extending lower lip of an attraction board, a second downwardly extending flange offset from said rear surface and parallel to said upper edge and said lower edge; and a symbol on said body visible from said front.

3. An attraction board comprising in combination:

a back having a plane, said back having a plurality of surfaces positioned generally parallel to said plane of said back, a plurality of parallel tracks, each of said tracks having an upwardly extending lower lip and an opposing downwardly extending upper lip, each of said upper lips and said lower lips immovably fixed to one of said surfaces, one of said tracks having one of said upper lip and said lower lip forwardly offset relative to the other of said upper lip and said lower lip of said one of said tracks, and said lips generally define a segment of the surface of a cylinder.

4. The combination comprising:

a back, a plurality of parallel tracks on said back, each of said tracks having an upwardly extending lower lip immovably fixed to said back and a downwardly extending upper lip immovably fixed to said back, said tracks including an upper track with an upper lip and a lower track with a lower lip,land an intermediate lip, one of said upper lip of said upper track and said lower lip of said lower track being forwardly offset relative to said intermediate lip, and a figure panel having an upper edge, a lower edge and a rear surface, a flange offset from said rear surface and parallel to said rear surface, and said flange hooked over said intermediate lip, and said upper edge of said figure panel extending under said upper lip of said upper track and said lower edge fitted under said lower lip of said lower track.

5. An attraction board comprising in combination:

a back, a plurality of parallel tracks on said back including an upper track and a lower track, said upper track having an upwardly extending lower lip immovably fixed to said back and an opposing downwardly extending upper lip immovably fixed to said back, said lower track having an upwardly extending lower lip immovably fixed to said back and an opposing downwardly extending upper lip immovably fixed to said back, one of said upwardly extending lower lip of said lower track and said downwardly extending upper lip of said upper track forwardly offset relative to said upwardly extending lower lip of said upper track, said downwardly extending upper lip of said lower track, and the other of said upwardly extending lower lip of said lower track and said downwardly extending upper lip of said upper track.

* * * * *

UNITED STATES PATENT AND TRADEMARK OFFICE

CERTIFICATE OF CORRECTION

PATENT NO. : 5,487,231

DATED : January 30, 1996

INVENTOR(S) : Anton Grate

It is certified that error appears in the above-identified patent and that said Letters Patent is hereby corrected as shown below:

In column 6, line 62, after "lower lip," delete "land" and substitute --and--.

Signed and Sealed this

Fourteenth Day of May, 1996

*Attest:*

*Attesting Officer*

BRUCE LEHMAN

*Commissioner of Patents and Trademarks*